US006918967B2

(12) United States Patent
Crum et al.

(10) Patent No.: US 6,918,967 B2
(45) Date of Patent: Jul. 19, 2005

(54) CORROSION RESISTANT AUSTENITIC ALLOY

(75) Inventors: James R. Crum, Ona, WV (US); Frances S. Suarez, Huntington, WV (US); Sarwan K. Mannan, Barboursville, WV (US); Vernon W. Hartmann, Culloden, WV (US)

(73) Assignee: Huntington Alloys Corporation, Huntington, WV (US)

( * ) Notice: Subject to any disclaimer, the term of this patent is extended or adjusted under 35 U.S.C. 154(b) by 16 days.

(21) Appl. No.: 10/221,809

(22) PCT Filed: Mar. 8, 2001

(86) PCT No.: PCT/US01/07525

§ 371 (c)(1),
(2), (4) Date: Feb. 10, 2003

(87) PCT Pub. No.: WO01/68929

PCT Pub. Date: Sep. 20, 2001

(65) Prior Publication Data

US 2004/0120843 A1 Jun. 24, 2004

Related U.S. Application Data

(60) Provisional application No. 60/189,669, filed on Mar. 15, 2000.

(51) Int. Cl.[7] ..... C22C 38/38

(52) U.S. Cl. ..... 148/327; 420/44; 420/45; 420/46

(58) Field of Search ..... 148/327; 420/44–46

(56) References Cited

U.S. PATENT DOCUMENTS

| | | | | |
|---|---|---|---|---|
| 4,007,038 A | | 2/1977 | Deverell | |
| 4,043,838 A | | 8/1977 | Deverell | |
| 4,078,920 A | | 3/1978 | Liljas et al. | |
| 4,545,826 A | | 10/1985 | McCunn et al. | |
| 4,876,065 A | | 10/1989 | Rocket et al. | |
| 4,883,544 A | | 11/1989 | Ueda et al. | |
| 4,981,646 A | | 1/1991 | Culling | |
| 5,141,705 A | | 8/1992 | Stenvall et al. | |
| 5,169,266 A | | 12/1992 | Sala et al. | |
| 5,480,609 A | * | 1/1996 | Dupoiron et al. | 420/45 |
| 5,830,408 A | | 11/1998 | Azuma et al. | |
| 5,841,046 A | | 11/1998 | Rhodes et al. | |
| 5,945,067 A | | 8/1999 | Hibner et al. | |
| 6,300,001 B1 | * | 10/2001 | Hornung et al. | 429/44 |

FOREIGN PATENT DOCUMENTS

| | | | |
|---|---|---|---|
| EP | 507229 | * | 10/1992 |
| JP | 06 306553 | | 11/1994 |
| JP | 06336659 | * | 12/1994 |
| JP | 08239735 | * | 9/1996 |
| KR | 28412 | | 4/1989 |
| WO | WO 98/33224 | | 7/1998 |

* cited by examiner

*Primary Examiner*—Sikyin Ip
(74) *Attorney, Agent, or Firm*—The Webb Law Firm

(57) ABSTRACT

An austenitic alloy having improved ductility/processability and improved pitting and crevice corrosion resistance comprising, in % by weight, about: 25–30% Ni; 19–23% Cr; 6–8% Mo; 0.3–0.5% N; 0.5% Mn; 0–1.5% Cu; 0–0.2% C; 0–1% Al; 0–0.01% S; 0–1% Ti; 0–1% Si; up to trace amounts of Mg, Ca, and Ce; and balance Fe plus incidental impurities.

8 Claims, 6 Drawing Sheets

Sigma Solvus, Temperature °F

Sigma Solvus, Temperature °F

25 Nickel 20.5Cr, Mo, N, Balance Fe

Sigma Solvus, Temperature °F

27 Nickel 20.5Cr, Mo, N, Balance Fe

PREN 22-27Ni, 20.5Cr, Mo, N, Balance Fe

Comparison of the Effects of Molybdenum and Nitrogen on Sigma Solvus Temperature and PREN Calculations 27 Ni, 20.5Cr, Mo, N, Balance Fe Comparison of PREN and Sigma Solvus for Various Compositions

CORROSION RESISTANT AUSTENITIC ALLOY

CROSS-REFERENCE TO RELATED APPLICATIONS

This application is a continuation of a 371 of PCT/US01/07525, filed Mar. 8, 2001, which claims the benefit of U.S. Provisional Application No. 60/189,669, filed Mar. 15, 2000.

BACKGROUND OF THE INVENTION

1. Field of the Invention

The present invention relates to nickel-iron-chromium alloys containing molybdenum for the purpose of providing resistance to pitting and crevice corrosion.

2. Discussion of the Related Art

Certain ferrous alloys including INCOLOY® alloy 25-6MO (hereinafter referred to as "alloy 25-6MO") are particularly useful for their exceptional resistance to many corrosive environments. INCOLOY® is a trademark of the Special Metals group of companies. Alloy 25-6MO nominally contains by weight percent 25 nickel, 20 chromium, and 6 molybdenum. Examples of such corrosion resistant alloys are disclosed in U.S. Pat. No. 4,545,826 as containing by weight percent 20–40 nickel, 14–21 chromium, 6–12 molybdenum, maximum of 2 manganese, and 0.15–0.30 nitrogen. These alloys are annealed at relatively high temperatures, namely, over 2100° F. (1149° C.), typically about 2200° F. (1204° C.).

These nickel-chromium-molybdenum alloys are particularly suited for use in chemical and food processing, pulp and paper bleaching plants, marine and offshore platforms, salt plant evaporators, air pollution control systems, and various equipment for the power industry. These are aggressive aqueous environments which contain halides. Accordingly, the alloys formed into components of such systems must have good resistance to pitting and crevice corrosion. In addition, the alloys must have good processability since they are fabricated into a variety of intricate forms. Processability includes well-known hot forming techniques such as forging and rolling or other forming operations such as drawing and bending to mention a few. However, it is difficult to produce a nickel-chromium-molybdenum alloy with good processability because high concentrations of Mo, Cr and N which provide pitting resistance are also known to be detrimental to the processability of the alloy.

Accordingly, a need remains for a nickel-chromium-molybdenum alloy having improved corrosion resistance as well as improved processability.

SUMMARY OF THE INVENTION

This need is met by the nickel-iron-chromium alloy of the present invention which most preferably includes about the following ranges by weight percent:

| ELEMENT | WEIGHT PERCENT (wt. %) |
|---|---|
| Ni | 26–29 |
| Cr | 20–22 |
| Mo | 6.5–7.5 |
| Mn | 0–5 |
| Cu | 0–1 |

-continued

| ELEMENT | WEIGHT PERCENT (wt. %) |
|---|---|
| N | 0.3–0.5 |
| Fe | Balance |

Heats of the alloys of the present invention containing nitrogen in the amount of about slightly greater than 0.3 wt. % to 0.4 wt. % exhibit significantly improved pitting resistance and exhibit improved crevice corrosion resistance over prior Ni—Cr—Mo alloys. Presently preferred lower limits for N are 0.31 wt. % and 0.33 wt. %. The alloys of the present invention also provide additional improved properties, such as: (1) at least 100° F. (38° C.) lower sigma solvus temperatures so as to decrease the propensity to form sigma phases during processing, (2) higher yield strength and good ductility, (3) allows the use of relatively low temperature annealing steps, namely, less than 2100° F. (1149° C.), and, hence, improved processability for forming various shaped components.

DESCRIPTION OF THE PREFERRED EMBODIMENTS

The present invention is an improvement over INCOLOY® alloy 25-6MO which exhibits improved pitting and crevice corrosion resistance as compared to prior Ni—Cr—Mo alloys. These improvements are believed to be the result of the inclusion of about 6.5–7.5 wt. % Mo and about 0.33–0.40 wt. % N to a corrosion resistant alloy such as INCOLOY® alloy 25-6MO.

In particular, the alloy of the present invention contains the elements set forth in Table 1 by weight percent of the alloy in about the following ranges:

TABLE 1

| | WEIGHT PERCENT | | | |
|---|---|---|---|---|
| ELEMENT | Broad | Medium | Narrow | Nominal |
| Ni | 25–30 | 26–29 | 26–28 | 27 |
| Cr | 19–23 | 20–22 | 20–21.5 | 21 |
| Mo | 6–8 | 6.5–7.5 | 6.6–7.5 | 7 |
| N | 0.3–0.5 | 0.31–0.35 | 0.33–0.4 | 0.35 |
| Mn | 0–5 | 0–5 | .5–1.5 | 1.0 |
| Cu | 0–1.5 | 0–1 | 0.7–1.0 | 0.8 |
| C | 0–0.2 | 0.01–0.2 | 0.01–0.02 | <0.02 |
| Al | 0–1 | 0.01–0.15 | 0.05–0.15 | 0.1 |
| S | 0–0.01 | 0–0.002 | <0.002 | <0.001 |

TABLE 1-continued

| ELEMENT | WEIGHT PERCENT | | | |
|---|---|---|---|---|
| | Broad | Medium | Narrow | Nominal |
| Ti | 0–1 | 0–1 | 0–0.03 | <0.03 |
| Si | 0–1 | 0.1 | 0.5 | <0.5 |
| Mg | <0.1 | | | |
| Ca | <0.1 | | | |
| Ce | <0.1 | | | |
| Fe and Incidental Impurities | Balance | Balance | Balance | Balance |

The alloy of the present invention may further contain up to 0.5 wt. % V.

A particularly preferred alloy of the present invention includes by weight percent about 27 Ni, 21 Cr, 7.2 Mo, 1.0 Mn, 0.8 Cu, and 0.33 N. The present invention is a result of both theoretical calculations and physical testing of alloys containing molybdenum for corrosive environments.

Figure 1:
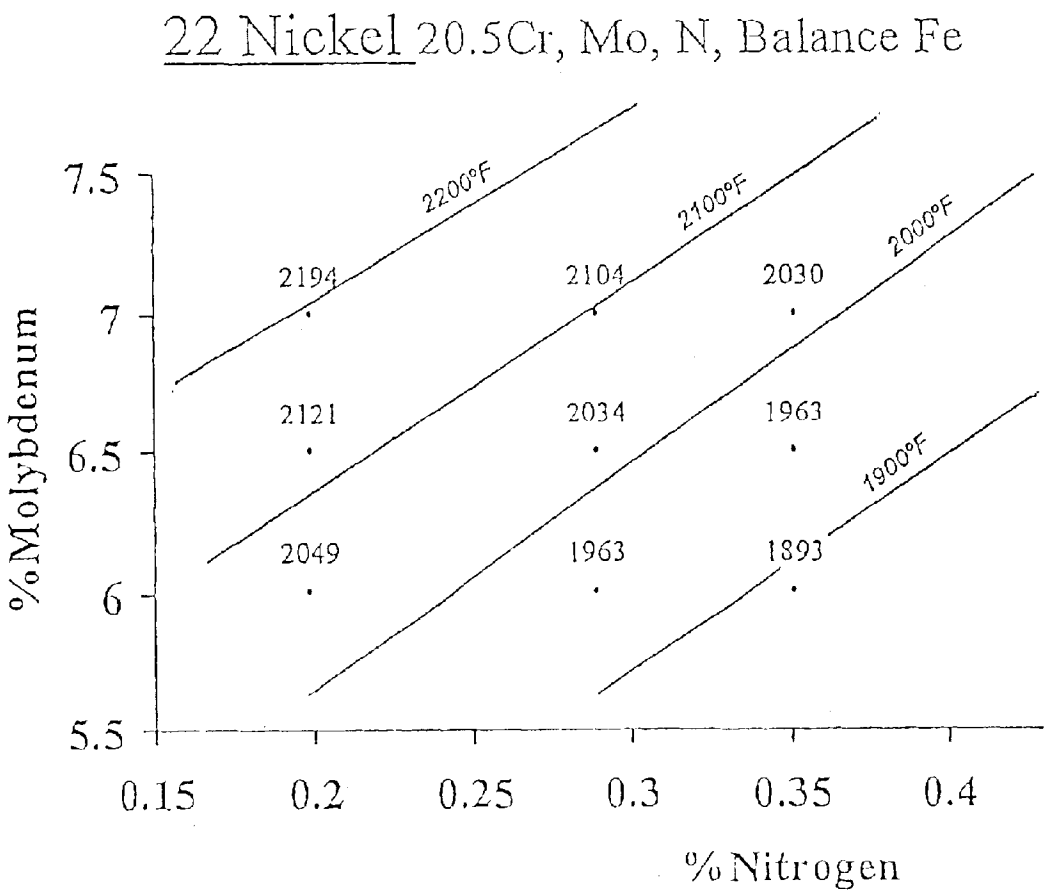
FIG. 1 is a graph of sigma solvus temperature contour lines at 22 wt. % nickel.
Figure 2:
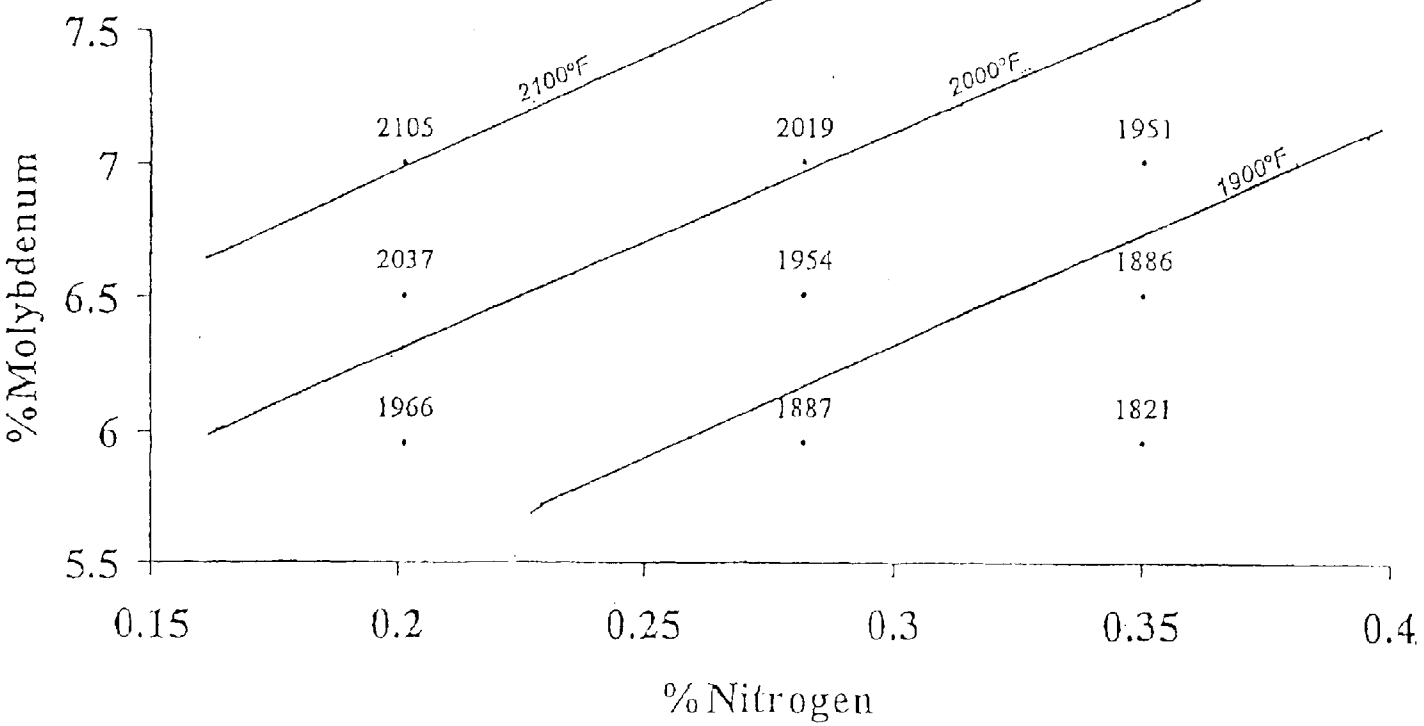
FIG. 2 is a graph of sigma solvus temperature contour lines at 25 wt. % nickel.
Figure 3:
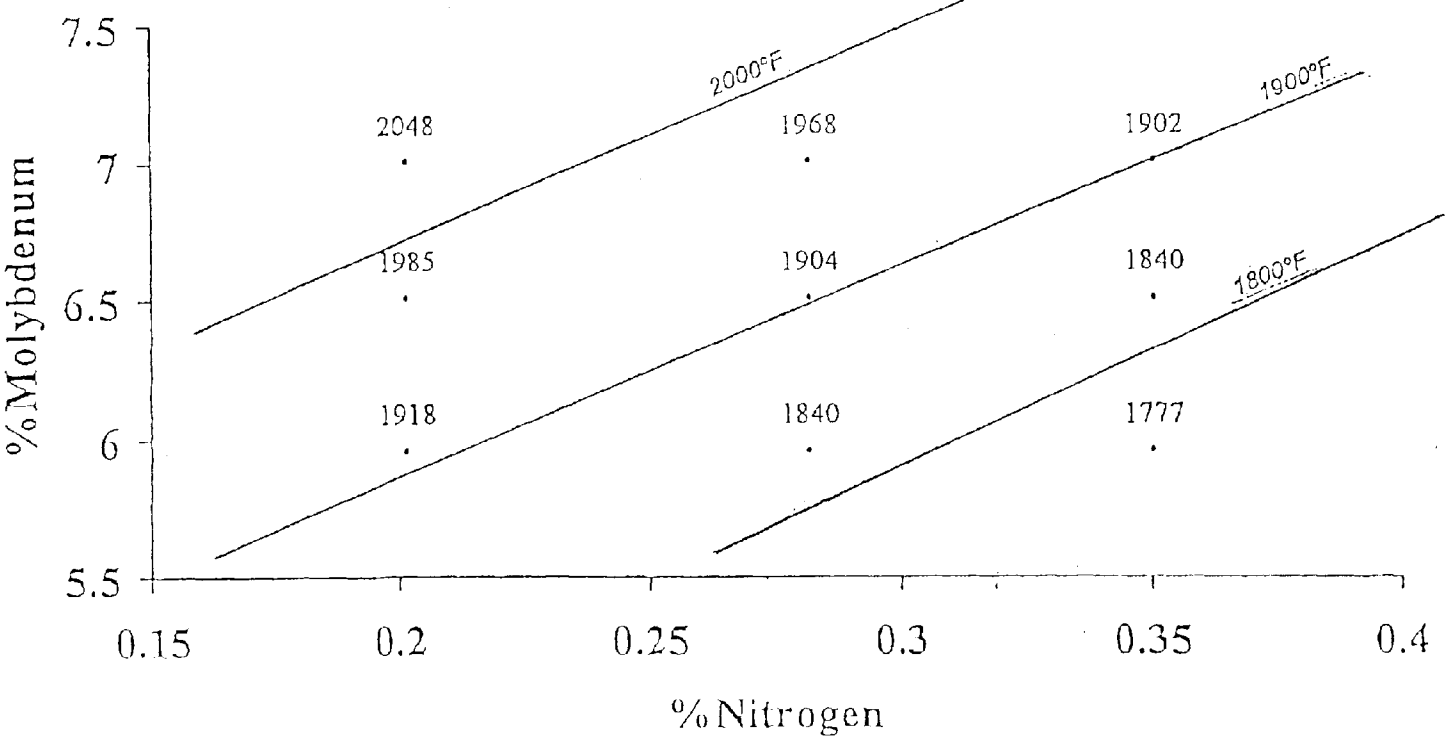
FIG. 3 is a graph of sigma solvus temperature contour lines at 27 wt. % nickel.
Figure 4:
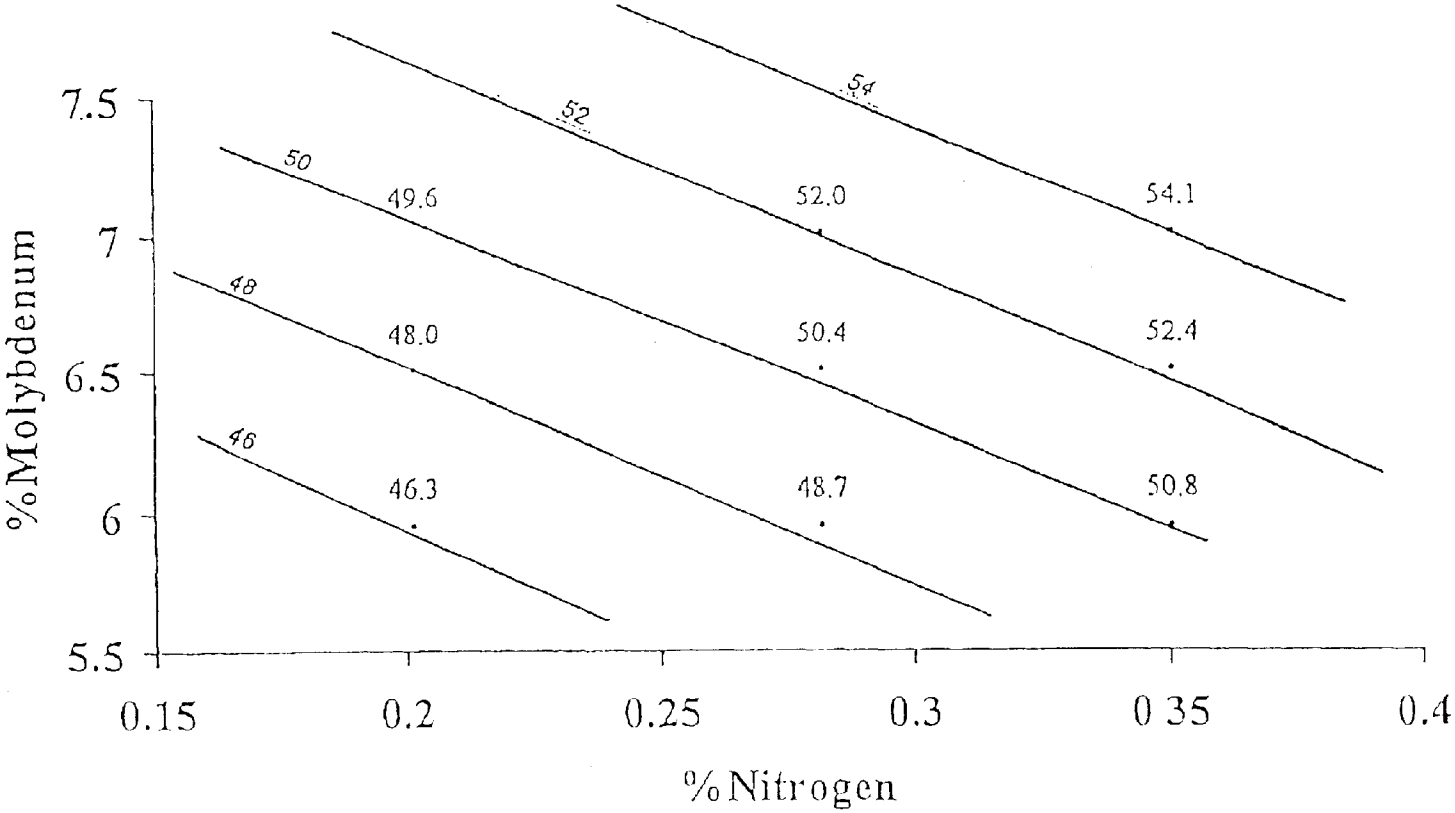
FIG. 4 is a graph of PREN contour lines at 22–27 wt. % nickel.

Certain theoretical calculations are known techniques for evaluating a potential alloy. These calculations include sigma solvus temperature and pitting resistance equivalent number (PREN) which is a numerical estimate of the pitting resistance based on the alloy composition where PREN equals % Cr+3.3 (% Mo)+30(% N). A high sigma solvus temperature in 6MO alloys (alloys containing about 6 wt. % molybdenum) has been known to result in poor metallurgical stability and excessive processing problems. One goal during development of the present invention was to define an alloy composition having the best possible combination of a high PREN for improved pitting resistance as well as a low sigma solvus temperature for stability and improved processing of the alloy. Calculations of sigma solvus temperatures and PREN numbers were made for a factorial design encompassing Ni at 22, 25 and 27 weight percent, Mo at 6.0, 6.5 and 7.0 weight percent, and N at 0.20, 0.28 and 0.35 weight percent with 20.5 Cr and the balance Fe. The calculated effect of Mo and N content on the sigma solvus temperatures in 22 Ni, 25 Ni and 27 Ni compositions are shown in FIGS. 1–3. The contour lines in FIGS. 1–3 are drawn to show various sigma solvus temperature levels. FIGS. 1–3 demonstrate that the higher contents of nickel and nitrogen decrease the sigma solvus temperature whereas increases in the amount of molybdenum increase the sigma solvus temperature. FIG. 4 presents contour lines for PREN values over a range of 6–7 wt. % Mo and 0.2–0.35 wt. % N in an alloy with 22–27 wt. % Ni and 20.5 wt. % Cr. FIG. 4 demonstrates that higher molybdenum and nitrogen levels lead to higher PREN numbers. Based on these calculated PREN values, the higher the molybdenum and nitrogen levels, the greater the resistance to pitting is expected. However, nitrogen was already shown in FIGS. 1–3 to decrease the sigma solvus temperature, whereas molybdenum increases the sigma solvus temperature.

Figure 5:
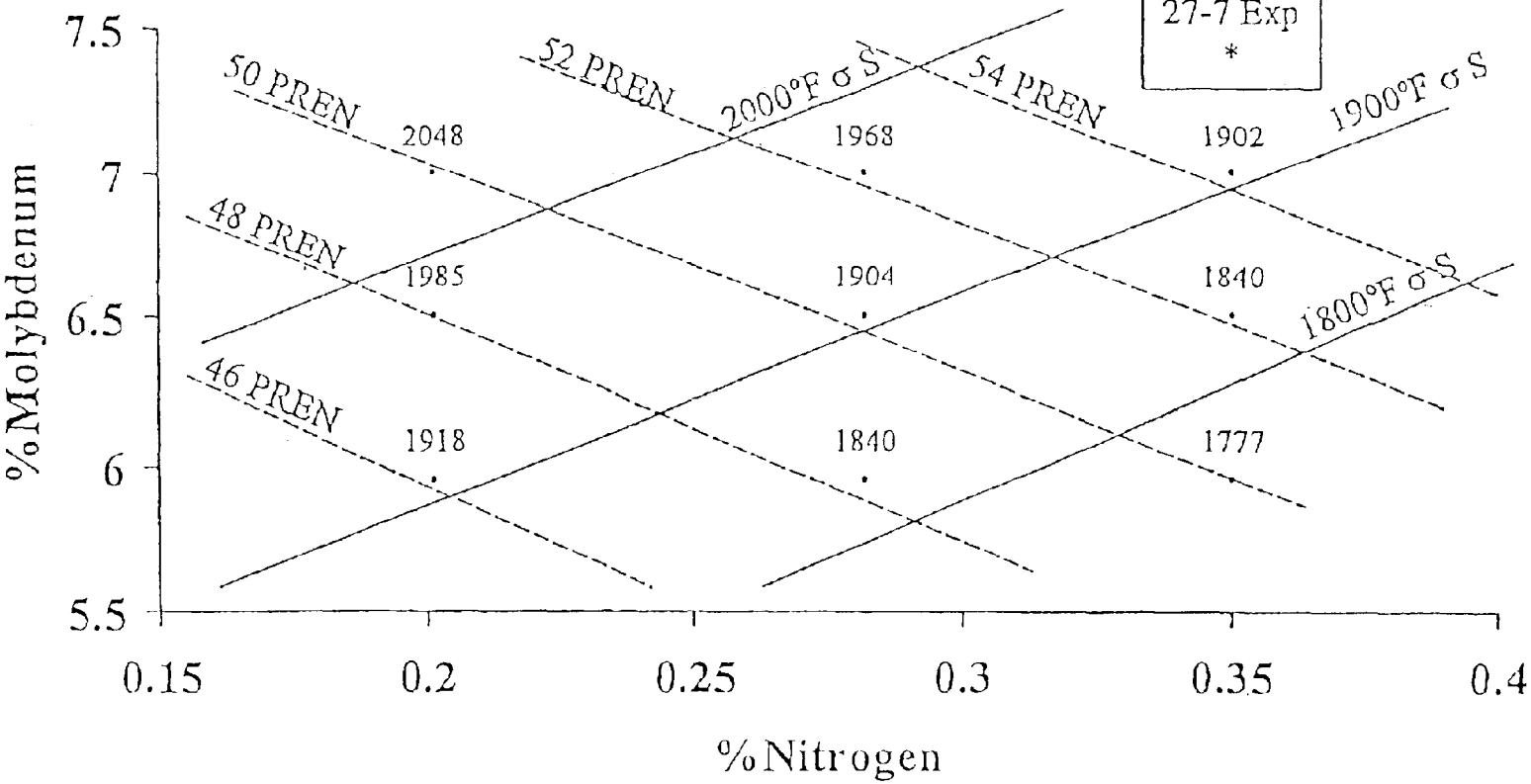
FIG. 5 is a graph of the comparison of the effects of molybdenum and nitrogen on both sigma solvus temperature and PREN calculations.

Hence, in the present invention, a balance was struck between these two desired goals. The desired lower sigma solvus temperatures dictate using a higher nitrogen content and lower molybdenum content while the desired PREN values suggest using higher molybdenum and nitrogen levels. This is shown graphically in FIG. 5 where the PREN contour lines are superimposed on the sigma solvus contour lines produced in FIGS. 1–4 for 27 Ni—20.5 Cr compositions. It was determined that the best combination of a relatively low sigma solvus temperature of about 1900° F. and an acceptable PREN level of about 54 was obtainable at a nitrogen level of about 0.35%. This is noted by the data point with an "*" for a 27-7 composition (27Ni, 20.5Cr, 7Mo and 0.35N). This 27Ni—20.5Cr—7Mo—0.35N composition was shown to have significantly higher PREN and lower sigma solvus temperatures than commercially available alloys. The common compositions of several commercial 6MO type alloys are set forth in Table 2.

TABLE 2

Composition of Common 6MO Type Alloys

| Element | 25-6MO | 6XN | 254SMO | 654SMO |
|---|---|---|---|---|
| Ni | 25 | 24 | 18 | 22 |
| Cr | 20.5 | 21 | 20 | 24 |
| Mo | 6.7 | 6.5 | 6.1 | 7.3 |
| N | 0.20 | .22 | .22 | 0.5 |
| Mn | 0.7 | | 0.6 | 3 |
| Cu | 0.9 | | 0.7 | 0.5 |
| σ Solvus | 2036° F. (1113° C.) | 2079° F. (1137° C.) | 2102° F. (1149° C.) | 2179° F. (1193° C.) |
| PREN | 48.0 | 49.0 | 46.4 | 63.1 |

Figure 6:
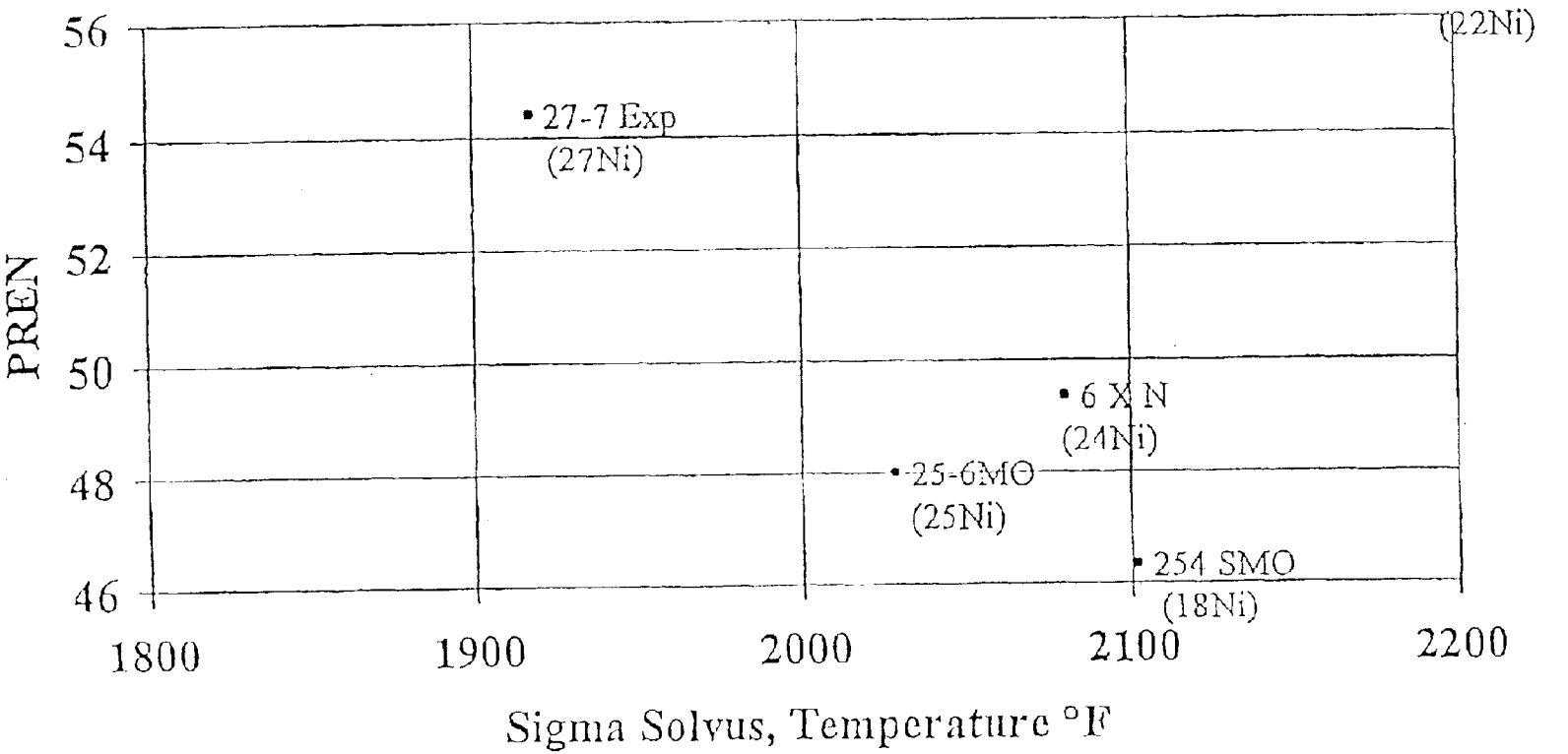
FIG. 6 is a comparison of PREN and sigma solvus temperatures for a composition of the present invention and prior art alloys.

Theoretical calculations show that 27Ni—20.5Cr—7Mo—0.35N composition has significantly lower sigma solvus temperature and higher PREN number than most of the conventional alloys, FIG. 6. Although alloy 654SMO has a very high PREN number, it also has a very high sigma solvus temperature, which corresponds with more difficult processing and product limitations and, hence, is less acceptable than the alloy of the present invention. The experimental sigma solvus temperature for a 27Ni—20.5Cr—7Mo—0.35N composition was marginally higher than the theoretical prediction.

It is believed that the molybdenum content can be about 6.5–7.5 wt. % and the nitrogen content can be about 0.33–0.40 wt. % to exhibit the desired balance of properties. Accordingly, the present invention lies in the use of about 6.5–7.5 wt. % Mo and about 0.33–0.40 wt. % N in a nickel-chromium alloy.

Although the invention has been described generally above, the following particular examples give additional illustrations of the product and process steps typical of the present invention.

EXAMPLE 1

Laboratory sized heats (50 lbs.) were produced by both air and vacuum melting. The amount of deoxidizing elements, other residuals and the hot rolling practice were varied as set forth in Table 3.

Ingots were rolled to 2.25 inch square, 0.250 inch flat, 0.125 inch strip and/or ⅝ inch rod. Chemical analyses were conducted on ladle samples and/or final products. Critical pitting temperature and crevice corrosion temperature (the lowest temperatures at which attack occurs) were both conducted according to ASTM G48, Practices C and D on annealed specimens with a 120 grit ground surface.

TABLE 3

| Heat | C | Mn | S | Si | Cu | Ni | Cr | Al | Ti | Mo | Mg | Ca | Ce | N | Sample | Process |
|---|---|---|---|---|---|---|---|---|---|---|---|---|---|---|---|---|
| | Experimental Compositions | | | | | | | | | | | | | | | |
| HV9240* | .010 | .59 | .005 | .45 | .05 | 26.00 | 20.61 | .01 | .02 | 6.59 | <.001 | <.001 | .001 | .36 | Ld Sq | Ho |
| HV9242A | .010 | .60 | .005 | .47 | .05 | 27.76 | 21.19 | .01 | .02 | 7.23 | .013 | .003 | .002 | .35 | Ld Plate | Ho, Ma |
| HV9244A | .012 | .59 | .003 | .45 | .05 | 25.91 | 20.73 | .01 | .01 | 6.64 | .010 | .002 | .001 | .34 | Ld Plate | Ho, Ma |
| HV9438 | .018 | .55 | .004 | .43 | .73 | 28.22 | 21.06 | .05 | .02 | 7.28 | .016 | <.001 | .005 | .35 | Ld Plate | Ho, Ma |
| HV9439 | .015 | 1.94 | .005 | .42 | .15 | 27.96 | 21.03 | .05 | .02 | 7.48 | .012 | <.001 | .006 | .35 | Ld Plate | Ho, Ma |
| HV9440 | .016 | .64 | .004 | .44 | .21 | 27.11 | 21.05 | .01 | .02 | 7.17 | .002 | .002 | .003 | .33 | Ld Plate | Ho, Ma |
| HV9441 | .018 | .57 | .004 | .44 | .21 | 27.11 | 21.07 | .01 | .02 | 7.17 | .003 | .003 | .002 | .34 | Ld Plate | Ho, Ma |
| HV9117A** | .048 | 1.93 | .002 | .34 | .85 | 25.93 | 20.01 | .11 | .00 | 6.79 | — | — | — | .20 | Plate | |

*Did not roll to plate, cut samples out of cracked 2.5" squares.
**Comparative Example
Ho = homogenize, Ma = machine ingot, Ld = ladle analysis, Sq = 2.5" square analysis

COMPARATIVE EXAMPLE

A 50 lb. laboratory heat of an alloy having less nitrogen than that of the present invention was produced and also appears in Table 3 as Heat HV9117A.

Results of the critical pitting temperature (CPT) and critical crevice corrosion temperatures (CCT) tests conducted on plate samples of certain of the alloys set forth in Table 3 are reproduced in Tables 4 and 5.

The data set forth in Tables 4 and 5 demonstrates that both pitting resistance and crevice corrosion resistance improve with increasing amounts of Mo and N. The typical CPT and CCT temperatures for conventional 25-6MO alloys are 158° CF (70° C.) and 95° F. (35° C.), respectively. Upon slightly increasing the Mo, as was done in Heat HV9117A of the Comparative Example, the CPT and CCT values were increased to 176° CF (80° C.) and 104° F. (40° C.), respectively. However, further increases in the amount of Mo and N in Heat HV9242A (an alloy of the present invention) increased the CPT and CCT values to 195° F. (85° C.) and 140° F. (60° C.), respectively. Hence, higher Mo and N levels are believed to be beneficial.

An autogenous gas tungsten arc welding (GTAW) test was conducted in the flat position on 0.062" thick sheet rolled from Heat HV9438 and others to evaluate tungsten deterioration and molten metal fluid flow. Visual examination of the tungsten after welding did not illustrate excessive deterioration or spalling. Weld-bead profile and geometry were not adversely affected by the 0.35 percent addition of nitrogen. In addition, the fluidity and wetting characteristics of the molten metal were not significantly degraded by the nitrogen additions.

The mechanical properties of the alloys of the present invention were also tested. The effect of annealing on room temperature tensile properties was tested for Heat HV9242A. INCOLOY® alloy 25-6MO generally is required to have a minimum 0.2% yield strength of 43 Ksi and a minimum elongation of 40%. To obtain these properties, it has been previously necessary to use a relatively high annealing temperature of 2200° F. (1204° C.) to obtain the desired ductility. Nevertheless, the strength at this ductility is often only marginally better than 43 Ksi. Table 6 presents the impact on room temperature properties of annealing temperatures from 2050° F. to 2150° F. on 0.125" strip formed from heat HV9242A after cold rolling to 50%. Table 7 presents the results of testing the same heat HV9242A as 0.150" strip after cold rolling to 50% when annealed at temperatures of 1800° F. to 2200° F. as compared to commercial heat of 25-6MO.

The data shows that higher yield strength and elongation are obtained for the new alloy as compared to 25-6MO throughout the annealing temperature range. It is believed that the higher nickel or lower sigma solvus temperature contributes to the improved ductility whereas the higher molybdenum and nitrogen content provide the high strength for the alloy. Alloy 25-6MO has a high sigma solvus temperature that requires a high annealing temperature of 2200° F. (1204° C.). The alloy of the present invention may be annealed at reduced temperatures compared to conventional alloy 25-6MO which also results in increased strength.

Thus, the alloy according to the present invention, with the combination of both a high PREN number ("pitting resistance equivalent number") and a low sigma solvus temperature, provides superior corrosion resistance with the added advantage of easier processing. A low sigma solvus temperature allows hot rolling or forming operations with less danger of precipitating deleterious sigma phase. Also, final annealing can be performed at a lower temperature than materials which are more prone to sigma phase and require a higher solution annealing temperature to remove unwanted precipitation. Lower processing and annealing temperatures reduce unwanted oxidation, lower energy costs and provide a higher strength, fine grain size final product.

TABLE 4

Critical Pitting Temperature Test Results in ASTM G48, C
0.250° Plate, HR + 2200° F./½ hr. WQ

| Heat No. | Composition | Test Temperature ° C. | Max. Pit Depth., mils |
|---|---|---|---|
| HV9117A | 26Ni—20Cr—6.8Mo—.20N | 70 | 0 |
| " | " | 75 | 0 |
| " | " | 80 | 5 |
| " | " | 85 | 5 |
| HV9242A | 28Ni—21Cr—7.2Mo—.35N | 70 | 0 |
| " | " | 75 | 0 |
| " | " | 80 | 0 |
| " | " | 85 | 11 |
| HV9244A | 26Ni—20.7Cr—6.6Mo—.34N | 70 | 0 |
| " | " | 75 | 0 |
| " | " | 80 | 20 |
| " | " | 85 | 5 |

Summary:
HV9117A CPT = 80° C.
HV9242A CPT = 85° C.
HV9244A CPT = 80° C.

TABLE 5

Critical Crevice Temperature Test Results in ASTM G48, D
0.250" Plate, HR + 2200° F./½ hr. WQ

| Heat No. | Composition | Test Temperature, ° C. | Max. Crevice Attack Depth, mils | % Crevices Attacked |
|---|---|---|---|---|
| HV9117A | 26Ni—20Cr—6.8Mo—.20N | 35 | 0 | 0 |
| " | " | 40 | 3 | 13 |
| " | " | 40 | 0 | 0 |
| " | " | 45 | 35 | 50 |
| " | " | 45 | 23 | 50 |
| HV9242A | 28Ni—21Cr—7.2Mo—.35N | 35 | 0 | 0 |
| " | " | 40 | 0 | 0 |
| " | " | 45 | 0 | 0 |
| " | " | 50 | 0 | 0 |
| " | " | 55 | 0 | 0 |
| " | " | 60 | 85 | 100 |
| HV9244A | 26Ni—20.7Cr—6.6Mo—.34N | 40 | 0 | 0 |
| " | " | 40 | 0 | 0 |
| " | " | 45 | 3 | 8 |
| " | " | 45 | 0 | 0 |
| " | " | 50 | 1 | 4 |
| " | " | 50 | 1 | 4 |
| " | " | 55 | 4 | 33 |
| " | " | 55 | 9 | 50 |

Summary:
HV9117A CCT = 40° C.
HV9242A CCT = 60° C.
HV9244A CCT = 45° C.

TABLE 6

Effect of Annealing Temperature on Room Temperature Tensile Properties
Heat HV9242A: 28Ni—21Cr—7.2Mo—0.35N
0.125" Strip, Cr 50% + Anneal

| Annealing Temperature | 0.2% Yield Strength Ksi | Tensile Strength Ksi | Elongation | Hardness Rb |
|---|---|---|---|---|
| 2050° F. (1121° C.)/1/4 h, WQ | 56.9 | 122.7 | 47.4 | 87 |
| 2100° F. (1149° C.)/1/4 h, WQ | 61.0 | 120.8 | 48.3 | 86 |
| 2150° F. (1177° C.)/1/4 h, WQ | 54.6 | 119.7 | 48.7 | 90 |

TABLE 7

Effect of Annealing Temperature on RTT Properties, Strip CR 50% + Anneal as Indicated
Exp. 4022 HV9242A, Strip 0.150", Test Drawing No. CR-15
Commercial 25-6MO Strip Z9237P, 0.063" Test Drawing No. T-9A

| Annealing Temp./ | 0.2% Y.S., Ksi | | ULT, Ksi | | % Elongation | | Hardness, HRb | |
|---|---|---|---|---|---|---|---|---|
| ¼ h, AC | HV9242A | 25-6MO | HV9242A | 25-6MO | HV9242A | 25-6MO | HV9242A | 25-6MO |
| 1800° F. (982° C.) | 69.2 | 65.7 | 132.7 | 126.2 | 32.0 | 31.69 | 99 | 97 |
| 1900° F. (1038° C.) | 66.0 | 59.4 | 129.9 | 119.3 | 39.6 | 37.5 | 97 | 94 |
| 1925° F. (1052° C.) | 66.1 | 59.0 | 131.2 | 118.8 | 41.9 | 37.3 | 96 | 91 |
| 1950° F. (1066° C.) | 60.5 | 55.5 | 128.5 | 113.6 | 44.0 | 40.0 | 93 | 88 |
| 1975° F. (1079° C.) | 63.8* | 46.3 | 129.0* | 102.5 | 45.2* | 45.2 | 93* | 95* |
| 2000° F. (1093° C.) | 60.3 | 47.7 | 125.5 | 107.8 | 48.5 | 43.8 | 94 | 84 |
| 2100° F. (1149° C.) | 54.2 | 43.1 | 122.3 | 98.8 | 50.0 | 42.0 | 92 | 84 |
| 2200° F. (1204° C.) | 57.3 | 41.3 | 119.2 | 96.4 | 50.4 | 42.2 | 87 | 81 |

*Average of duplicate test

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

We claim:

1. A corrosion resistant austenitic alloy consisting essentially of, in % by weight, Ni: 26–30

Cr: 20–22

Mo: 6.5–7.5

N: 0.31–0.35

Mn: 0–5

Cu: 0–1.5

C: 0–0.2

Al: 0–1

S: 0–0.01

Ti: 0–1

Si: 0–1

Mg: up to trace amounts

Ca: up to trace amounts

Ce: up to trace amounts

Fe: balance including incidental impurities; and wherein the alloy has a sigma solvus temperature of less than 2000° F. for improved processability and a pitting resistance equivalent number (PREN) of 50 or greater, wherein:

PREN=% Cr+3.3(% Mo)+30% N.

2. The alloy of claim 1, including about 26–29% Ni; 20–22% Cr; 6.5–7.5% Mo and 0.33–0.35% N.

3. The alloy of claim 1, including about 26–28% Ni; 20–21.5% Cr; 6.6–7.5% Mo and 0.33–0.35% N.

4. The alloy of claim 1, including about 27% Ni; 21% Cr; 7.2% Mo; 0.33% N; 1.0 Mn and about 0.8 Cu.

5. A corrosion resistant austenitic alloy consisting essentially of, in % by weight, Ni: 26–29

Cr: 20–22

Mo: 6.5–7.5

N: 0.31–0.35

Mn: 0–5

Cu: 0–1

C: 0–0.2

Al: 0–1

S: 0–0.01

Ti: 0–1

Si: 0–1

Mg: up to trace amounts

Ca: up to trace amounts

Ce: up to trace amounts

Fe: balance plus incidental impurities; and wherein the alloy has a sigma solvus temperature of less than about 2000° F. for improved processability and has a pitting resistance equivalence number (PREN) of about 54 or greater, wherein:

PREN=% Cr+3.3(% Mo)+30(% N).

6. A corrosion resistant austenitic alloy consisting essentially of, in % by weight, Ni: 26–28

Cr: 20–21.25

Mo: 6.6–7.5

N: 0.33–0.35

Mn: 0–5

Cu: 0–1

Al: 0–1

S: 0–0.01

Ti: 0–1

Si: 0–1

Mg: up to trace amounts

Ca: up to trace amounts

Ce: up to trace amounts

Fe: balance plus incidental impurities; and wherein the alloy has a sigma solvus temperature of less than 2000° F. for improved processability and has a pitting resistance equivalence number (PREN) of about 54 or greater, wherein:

PREN=% Cr+3.3(% Mo)+30(% N).

7. A corrosion resistant austenitic alloy having a nominal composition consisting essentially of, in % by weight, about:

Ni: 27

Cr: 21

Mo: 7.2

N: 0.35

Mn: 0.5–1.5

Cu: 0.8

Al: 0–1

S: 0–0.01

Ti: 0–1

Si: 0–1

Mg: up to trace amounts

Ca: up to trace amounts

Ce: up to trace amounts

Fe: balance plus incidental impurities; and wherein the alloy has a sigma solvus temperature of about 1900° F. for improved processability and has a pitting resistance equivalence number (PREN) of about 54 or greater, wherein:

PREN=% Cr+3.3(% Mo+30(% N).

8. The alloy of claim 7, having a critical pitting temperature (CPT) of greater than 80° C. and a critical crevice corrosion temperature (CCT) of greater than 50° C.

* * * * *

UNITED STATES PATENT AND TRADEMARK OFFICE

CERTIFICATE OF CORRECTION

PATENT NO. : 6,918,967 B2
DATED : July 19, 2005
INVENTOR(S) : Crum et al.

It is certified that error appears in the above-identified patent and that said Letters Patent is hereby corrected as shown below:

Tile page,
Item [75], Inventors, "Frances S. Suarez" should read -- Francis S. Suarez --.

Signed and Sealed this

Twenty-fourth Day of January, 2006

JON W. DUDAS
*Director of the United States Patent and Trademark Office*